US005386934A

United States Patent [19]

Lawrence

[11] Patent Number: 5,386,934

[45] Date of Patent: Feb. 7, 1995

[54] TICKET DISPENSER RETROFIT

[75] Inventor: Robert T. Lawrence, Princeton, Mass.

[73] Assignee: Rachelco, Inc., Boston, Mass.

[21] Appl. No.: 120,933

[22] Filed: Sep. 13, 1993

[51] Int. Cl.[6] ..... B65H 17/10

[52] U.S. Cl. ..... 226/181; 226/188

[58] Field of Search ..... 225/106; 226/187, 193, 226/181, 143, 144, 24, 188

[56] References Cited

U.S. PATENT DOCUMENTS

| | | | |
|---|---|---|---|
| 4,272,001 | 6/1981 | Horniak | 226/187 |
| 4,579,269 | 4/1986 | Lasley | 226/144 X |
| 5,113,758 | 5/1992 | Chou | 226/144 X |
| 5,215,383 | 6/1993 | Hilton | 226/143 X |

OTHER PUBLICATIONS

"Quick Release Metal Ticket Guide", advertisement by Deltronics Labs Inc.

"Deltronic Labs Ticket Dispenser, Request the industry standard in ticket dispensers", advertisement by Deltronic Labs Inc.

*Primary Examiner*—Andrew M. Falik

*Attorney, Agent, or Firm*—Bromberg & Sunstein

[57] ABSTRACT

A ticket dispenser retrofit for converting a ticket dispenser from accepting wide tickets into a ticket dispenser that accepts and controls the delivery of narrower tickets. A feed slide that fits snugly between the side framework plates of the standard ticket dispenser is provided with a longitudinal guide rail protruding up from the slide. A smooth top surface adjacent the guide rail accommodates the narrower tickets. The feed slide has a first opening for accommodating the sensing device of the ticket dispenser and a second opening for accommodating a drive roller and guide roller of the ticket dispenser retrofit. The drive roller has an enlarged feed wheel disposed more to one end of its hollow shaft. A top slide closure is provided with first and second openings that are aligned with the openings in the feed slide. The guide rail of the feed slide holds the narrower ticket in proper position with respect to the sensing device of the standard ticket dispenser so as to reliably control the delivery of the tickets from the dispenser.

15 Claims, 3 Drawing Sheets

TICKET DISPENSER RETROFIT

BACKGROUND OF THE INVENTION

The present invention relates to retrofitting ticket dispenser, in particular, a retrofit that converts a ticket dispenser from handling wide tickets to a dispenser that handles narrower tickets.

Amusement devices, such as skee ball games, are often equipped with ticket dispensers for issuing tickets as representative of prizes upon scoring a bullseye or a high score. The tickets are redeemed at the amusement center for prizes. The standard ticket dispenser in the industry is designed for use with wide tickets that are made available in fan-folded packages. In particular, the industry standard ticket dispenser is Model No: DL-1275 sold by Deltronic Labs, Inc., of Chalfont, Pa. A standard fan-folded ticket is 2" long and 1⅛" wide. The fan-folded package of tickets is more expensive than a coiled roll of tickets. Unfortunately, the machinery for making rolls of tickets is standardized to produce narrower tickets. The standard roll of tickets provides tickets that are 2" long and 1" wide. While the difference in sizes may not be dramatic, it is enough to cause problems if the narrower tickets are substituted for the wide tickets in the dispenser. Moreover, the difference in cost between the two tickets can run into the tens of thousands of dollars for companies that own and operate a large number of amusement centers that use these ticket dispensers.

Both the narrower and the wide tickets are notched at the edges of the intersection between adjacent tickets. The notches are used by the ticket dispenser which has an optical sensor along the edge of the tickets which senses the notch so that it can count the number of tickets that are being dispensed. In this manner a specified number of tickets are dispensed in accordance with the number of tickets that have been won in the associated amusement device.

Because of the large savings in cost in going from the wide fan-folded tickets to the narrower roll of tickets, there has been a long established need in the amusement industry to make the standard ticket dispensers useful with the narrower tickets. As it stands, if the narrower tickets are substituted for the wide tickets, a player at the amusement device receiving the tickets may wiggle the narrow ticket back and forth in the wider track provided by the standard ticket dispenser. In this manner the optical sensor along the edge of the ticket dispenser may be thrown off in its count of the number of tickets being dispensed. Perhaps even more importantly, by wiggling the tickets back and forth there may be a tendency for the tickets to jam in the machine. It is therefore highly desirable in the industry to provide a ticket dispenser that is suitable for the narrower roll of tickets and to provide such a dispenser at as minimal a cost as possible.

SUMMARY OF THE INVENTION

The present invention is directed to an apparatus for retrofitting the standard ticket dispensers so that they will be usable with the rolls of narrower tickets. The present invention advantageously makes use of the existing standard ticket dispensers so that new dispensers need not be manufactured. The savings from switching from the wide tickets to the narrower tickets is so substantial that the cost of retrofitting the standard ticket dispenser in accordance with the present invention will be quickly paid for by the savings in ticket costs.

The retrofit of the present invention includes a modified feed slide having full width that snugly fits within the existing ticket dispenser. A longitudinally arranged guide rail along the feed slide provides a narrower path for the narrow tickets through the dispenser. A first opening along the edge of the feed slide is used by the optical sensor of the ticket dispenser for sensing the notch between each of the tickets in the narrow ticket roll. The longitudinal guide rail advantageously holds the narrow tickets against the edge of the ticket dispenser so that the optical sensor will reliably count the tickets dispensed from the machine. A second opening along the edge of the output end of the feed slide is provided to accommodate the new rollers that may be provided along with the retrofit. A drive roller is turned by the ticket dispenser to feed the tickets along the slide and out through the ticket dispenser outlet. A top slide closure having a flat bottom surface rests upon the longitudinal guide rail of the feed slide and has first and second openings that align with the openings in the feed slide. The drive roller has a hollow shaft and a setscrew hole radially extending through the shaft and an enlarged feed wheel for pressing against the tickets. An accompanying guide roller includes a hollow shaft, an enlarged diameter portion for exerting pressure against the enlarged feed wheel of the drive roller and bearings on each end of the shaft to allow free rotational movement of the guide roller. The drive roller is driven by the ticket dispenser and the guide roller freely follows as the tickets move through the dispenser. The enlarged feed wheels of the rollers are arranged on one end of the associated shafts so as to be arranged appropriately over the narrow tickets. The drive roller may be provided with one or more rubber O-rings to improve the grip upon the tickets as they are being pulled through the dispenser.

In accordance with the method of retrofitting a standard ticket dispenser, the wide fan-folded tickets are replaced by the roll of narrow tickets. The existing ticket dispenser is disassembled by unscrewing the side wall of the dispenser. The set screw on the drive roller is loosened so that the drive roller can be removed along with removal of the freely rotating idler roller. The existing guide plates are also removed. The drive roller and guide roller of the retrofit are inserted in place on the one wall of the ticket dispenser. The feed slide with a longitudinal guide rail and the accompanying top slide closure are inserted into position in the wall of the ticket dispenser. The set screw on the drive roller is tightened. The side wall of the ticket dispenser is replaced against the new retrofit items including the drive roller, guide roller, feed slide and top slide closure. The leading ticket in the narrow roll of tickets is inserted between the feed slide and the top slide closure between the side wall of the ticket dispenser and the longitudinal guide rail on the feed slide. The ticket web is pushed through the feed slides into contact with the drive roller and guide roller so that automatic operation of the ticket dispenser can be initiated.

The retrofit of the present invention provides the amusement center with enormous savings in the costs of the tickets dispensed by the ticket dispensers on its games. Other objects and advantages of the invention will become apparent during the following description of the presently preferred embodiment of the invention taken in conjunction with the drawings.

DETAILED DESCRIPTION OF THE PREFERRED EMBODIMENT

Figure 1:
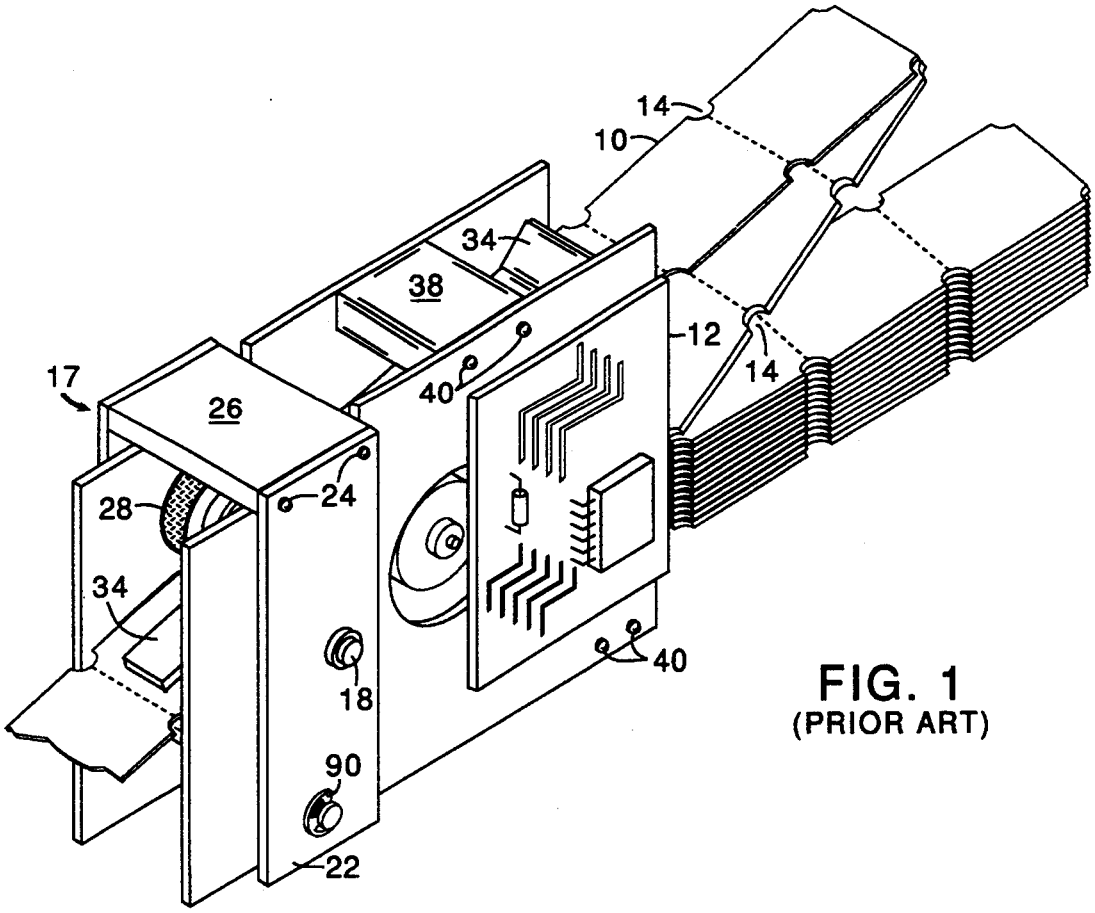
FIG. 1 (PRIOR ART)
FIG. 1 is a perspective view of a standard ticket dispenser of the prior art using the wide fan-folded tickets.
Figure 1A:
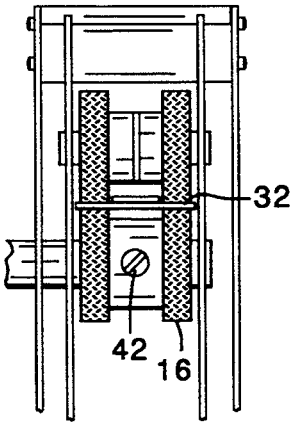
FIG. 1A (PRIOR ART)
FIG. 1A is a front view of the standard ticket dispenser of FIG. 1.
Figure 2:
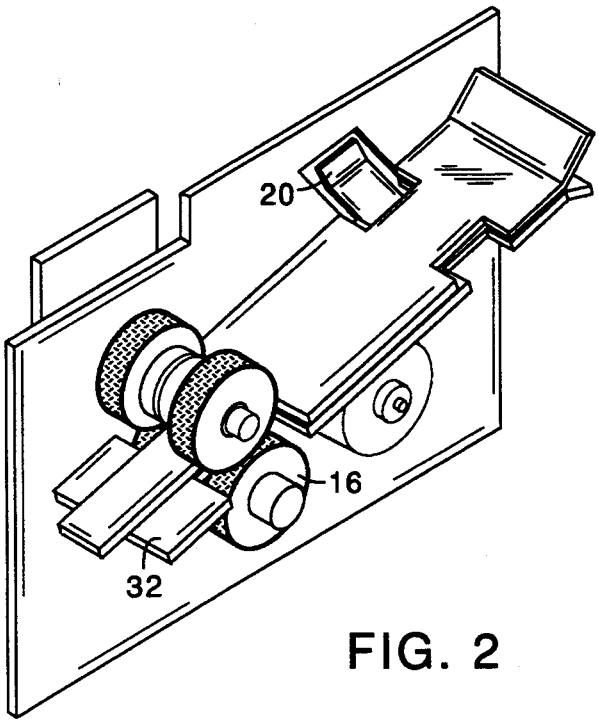
FIG. 2 is a perspective view of the ticket dispenser of FIG. 1 undergoing the retrofitting method of the present invention upon removal of the side wall of the dispenser.

Referring now to the drawings, FIG. 1 is an illustration of the standard ticket dispenser of the prior art. This dispenser is described in U.S. Pat. No. 4,272,001 (Horniak). The full disclosure of U.S. Pat. No. 4,272,001 is hereby incorporated by reference herein. The standard ticket dispenser has been sized to accommodate the 1⅛" wide fan-folded tickets 10 as shown in FIG. 1. The distance between the two side framework plates is 1¼". A leaf spring 20, shown in FIG. 2, is mounted to one of the side framework plates to urge the tickets against the opposing plate. Mounted on the opposing plate is a circuit board 12. A sensing device 30 is mounted on the circuit board 12 such that it extends through an opening in the side framework plate. The conventional sensing device includes a photoelectric cell. The photoelectric cell detects the notches cut out of the side edges in between adjacent tickets in a web of tickets. The leaf spring 20 helps to maintain the web of tickets 10 in proper alignment with the sensing device 30 such that the absence of a ticket in the photo electric cell means that a notch 14 is present rather than that the tickets themselves have been pulled off track away from the sensing device.

A drive roller 16 is mounted on a drive shaft 18. The drive shaft 18 extends from a gear box 36 and spans across the two side framework plates. A swing yoke frame 17 is supported about the two side framework plates and supports the drive shaft 18 at either end. A side plate 22 of the yoke is attached by a pair of screws 24 to the base 26 of the yoke. An idler roller 28 is mounted between the two side framework plates so as to frictionally engage the drive roller 16. The drive roller 16 and the idler roller 28 of the standard ticket dispenser each have two enlarged hubs separated from one another to grab the wide ticket on its outer edges. The tickets are guided through the ticket dispenser along a bottom guide plate 32 and a top guide plate 34. These two guide plates are provided with openings on opposite edges to accommodate the enlarged hubs of the drive roller and the idler roller. There are also openings along the edges of the guide plates to accommodate the sensing device 30 along one edge and the leaf spring 20 along the opposite edge. Spacer blocks 38, each 1¼" in length, are provided in two positions between the two side framework plates and screwed between the two to hold the width dimension between the plates constant.

The ticket dispenser of FIG. 1 is suitable for operation with the wide fan-folded package of tickets 10. The tickets 10 are inserted through the space between the bottom guide plate and the top guide plate. The tickets 10 are grabbed between the drive roller 16 and the idler roller 28. The leaf spring 20 holds the tickets in position beneath the sensing device 30 so that an accurate count is made of the tickets as they are driven out of the dispenser. If the wide tickets are replaced by the narrow tickets produced on a roll, the ticket dispenser has problems. The narrow tickets are provided with more leeway within the passage between the guide plates such that a child receiving tickets from the dispenser may wiggle the tickets to the left and right which can cause one of several malfunctions. The tickets may jam. The sensor may not be able to see the tickets if they are pulled to the side away from the sensor. Thus the tickets may be continually ejected while the sensor awaits to see the next ticket come through. In order to overcome these problems, I have found it insufficient to displace the leaf spring 20 closer towards the sensing device 30. This still leaves room for a child to wiggle the tickets back and forth within the guide plates. As a result, the ticket dispenser is subject to frequent jamming. The present invention advantageously adapts the ticket dispenser so that it can reliably handle the less expensive narrow ticket rolls.

The invention is an apparatus and method for retrofitting the ticket dispenser. In accordance with the first step of the invention, the side framework plate and the side plate 22 on the yoke, all located on the side of the dispenser carrying the circuit board 12, are removed. These are removed by unscrewing the screws 24 that hold the yoke together and by removing the screws 40 that hold the side plate against the spacer blocks 38. With the side plates removed, the ticket dispenser looks as in FIG. 2.

The idler roller 28 can be slid off its axle fairly easily. The drive roller is secured to its axle by a set screw 42. The set screw 42 must be unscrewed partially to release the drive roller from its axle. The drive roller may then be removed from the ticket dispenser. The top guide plate 34 and bottom guide plate 32 will simply fall out of the dispenser.

Figure 3:
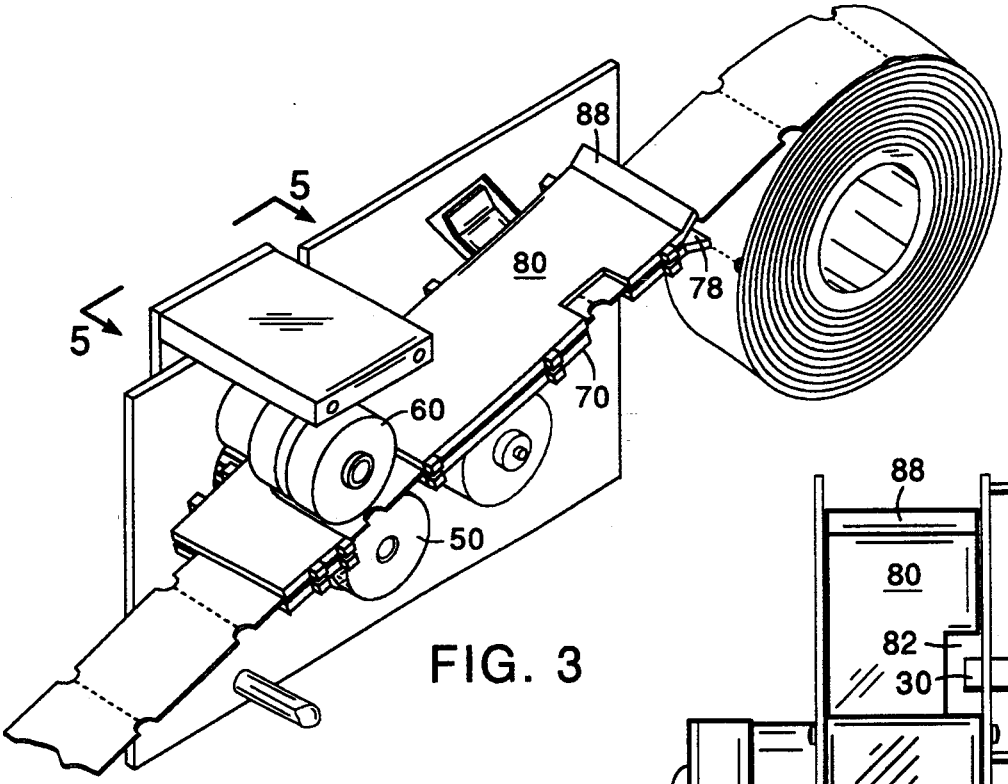
FIG. 3 is a perspective view of the retrofit ticket dispenser of the present invention with the sidewall removed to allow a better view of the retrofit apparatus.
Figure 4:
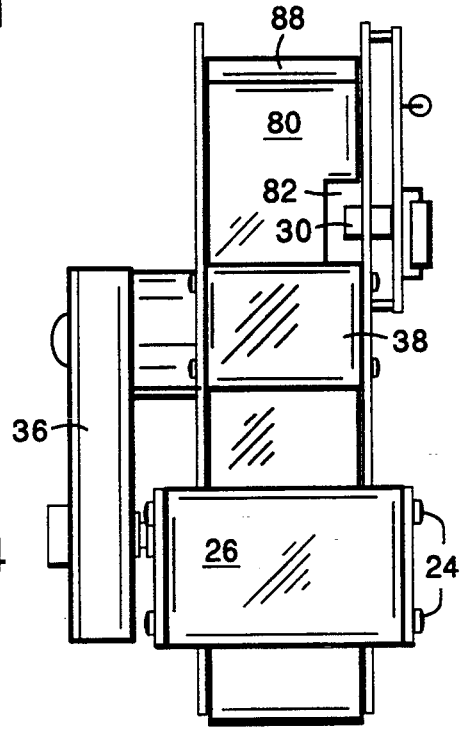
FIG. 4 is a plan view of the completed retrofit ticket dispenser of the present invention which has been converted for handling a roll of narrow tickets.
Figure 5:
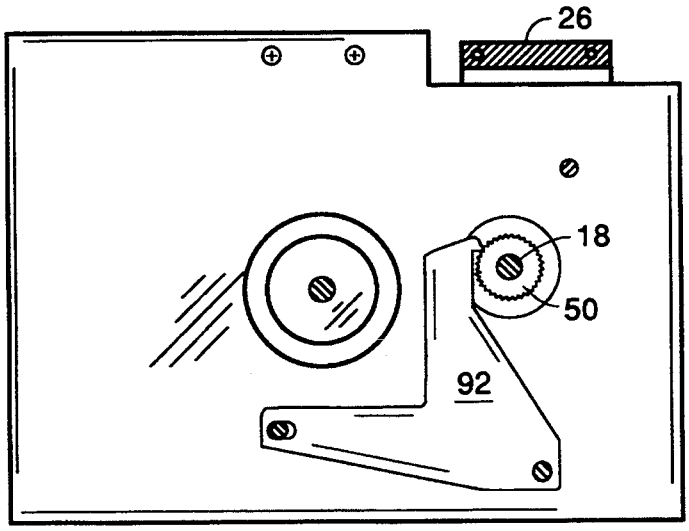
FIG. 5 is a left side view of the ticket dispenser of FIG. 3 taken through lines 5—5.

Referring now to FIG. 3, the idler roller, the drive roller and the guide plates are replaced with the ticket dispenser retrofit of the present invention. The bottom guide plate is replaced by a feed slide 70 having an upward projecting member longitudinally arranged on top of the feed slide. The presently preferred upward projection is a longitudinal guide rail 75. The feed slide 70 includes a first opening 72 along its edge near the input end of the slide to accommodate the sensing device 30. An opening on the opposite edge from the sensing device is not needed. In accordance with the invention, the need for the leaf spring 20 is eliminated. The top slide closure 80 replaces the top guide plate. The top slide closure has a first opening 82 that is in alignment with the first opening 72 on the edge of the feed slide 70. The feed slide 70 and the top slide closure 80 also include a second opening 74, 84 near the outlet opening of the slides to accommodate the drive roller 50 and idler roller 60. Each of the feed slide 70 and the top slide closure 80 have nubs 76, 86 extending out from their respective edges to mate with holes in the side framework plates of the ticket dispenser. The feed slide 70 and the top slide closure 80 are inserted in place. The drive roller 50 of the ticket dispenser retrofit is slid over the drive axle of the ticket dispenser. A set screw seated in a set screw hole 53 radially extending through the shaft of the drive roller 50 is screwed against the drive axle. The set screw thus secures the drive roller to the drive axle. The idler roller of the ticket dispenser retrofit is slid over the idler axle. As an alternative, instead of replacing both rollers after the feed slide and top slide closure are in place, one of the rollers can be inserted before the feed slide and top slide closure and the other roller inserted afterwards.

The side framework plate is replaced onto the ticket dispenser and screws 40 are tightened to hold the side framework plate against the spacer block 38. A washer is inserted over the idler axle to secure the axle in place between the side framework plates. A hub with bearings is inserted over the drive roller axle. A washer is also inserted over a pivot shaft 90 at the bottom of the yoke 17. The yoke side plate 22 is then replaced and screwed into the yoke spacer block 26.

Figure 6:
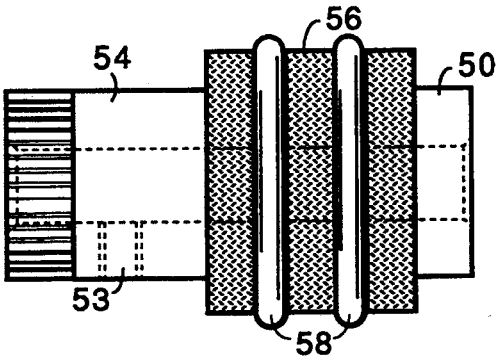
FIG. 6 is a side view of the drive roller of the retrofit apparatus of the present invention.

The components of the ticket dispenser retrofit of the present invention shall now be described in greater detail. The drive roller 50 of the retrofit is shown in FIG. 6. The drive roller 50 is formed on a hollow shaft 54. The longitudinal passage through the shaft 54 accommodates the drive axle. A setscrew hole 53 extends radially from the hollow passage in the shaft 54 out to the outer circumference of the shaft. The setscrew hole 53 accommodates the setscrew for securing the drive roller 50 to the drive axle. The periphery of the hollow shaft 54 has a straight medium knurl all about the periphery for engaging a pawl lever 92 located on the side of the ticket dispenser. The pawl lever 92 and the outer knurl about the hollow shaft are arranged to function so that tickets cannot be pulled out from the ticket dispenser. If the tickets are being pulled when the dispenser has not been electronically instructed to deliver tickets the pawl lever 92 will lock against the knurled edge of the hollow shaft 54 to squeeze the tickets more tightly between the guide roller and the drive roller to prevent tickets that have not been won from being pulled out of the dispenser. In order to accommodate the narrower ticket which will be guided along an edge of the feed slide 70 the drive roller 50 has an enlarged feed wheel 56 that is disposed more to one end of the shaft, in particular, the end of the shaft opposite the knurled outer edge. A pair of O-rings 58 are inserted about the enlarged feed wheel. The O-rings may be made of rubber or a like substance. The O-rings pull against one side of the tickets. The drive roller may be alternatively designed without the O rings and instead using a diamond knurled outer surface on the enlarged feed wheel to engage the ticket surface.

Figure 7:
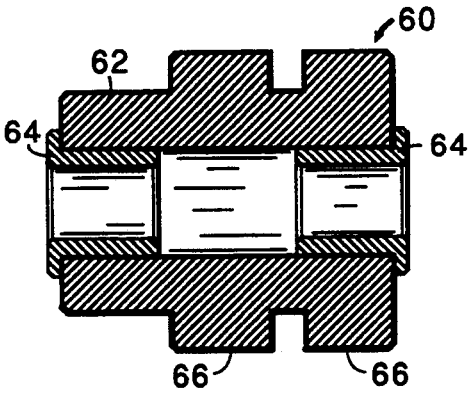
FIG. 7 is a cross-section view of the guide roller of the present invention.

The idler roller replacement of the ticket dispenser retrofit is shown in FIG. 7. The guide roller is formed from a hollow shaft 62. A bearing 64 is inserted into each end of the hollow shaft 62. The presently preferred bearings are a Boston Gear bearing, catalog no. FB46-3, item number 35528. The guide roller has at least one and, as shown in FIG. 7, preferably two enlarged feed wheels 66 enlarged diameter portions for exerting pressure against the enlarged feed wheel of the drive roller 50. The enlarged diameter portions of the guide roller 60 are disposed more to one end of the shaft to align with the enlarged feed wheel of the drive roller 50.

Figure 8A:
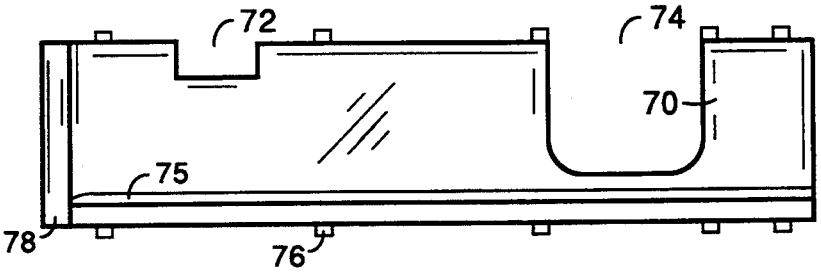
FIG. 8A and FIG. 8B are a plan view and a side view, respectively, of the feed slide of the present invention.
Figure 8B:
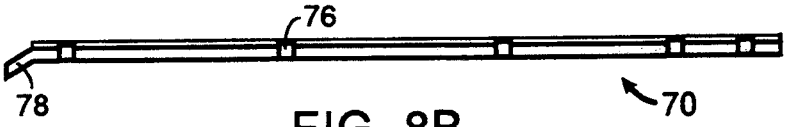
Figure 9A:
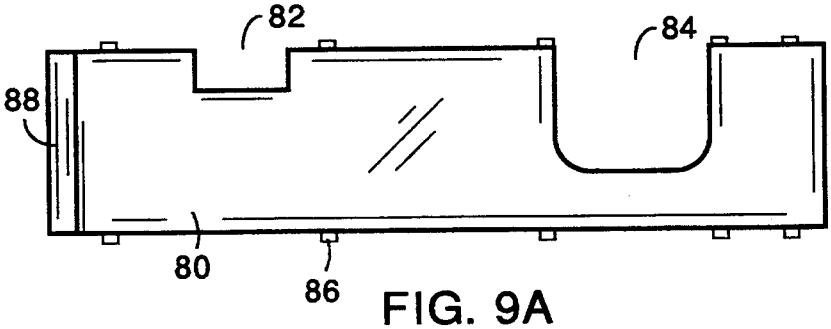
FIG. 9A and FIG. 9B are a plan view and a side view, respectively, of the top slide closure of the present invention.
Figure 9B:
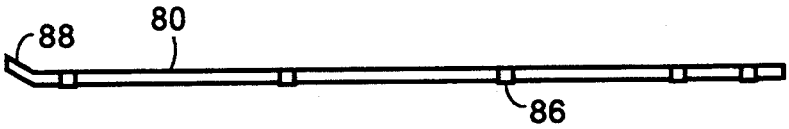

The feed slide 70 of the present invention in shown in FIGS. 8A and 8B. The width of the feed slide 70 is set so as to provide snug insertion between the side framework plates of the automated ticket dispenser. The preferred width dimension of the feed slide for the standard ticket dispense is 1.242". Extending out from the edges of the feed slide 70 are a plurality of nubs 76. The nubs 76 are located so as to engage mating holes in the side framework plates of the ticket dispenser. The feed slide 70 is advantageously provided with a longitudinal guide rail 75 protruding up from the feed slide. The feed slide 70 provides a smooth top surface between the longitudinal guide rail and the edge of the feed slide. The smooth surface permits that tickets to be pulled easily through the chute between the feed slide and the top slide closure. The width of the top surface between the edge of the feed slide and the longitudinal guide rail is slightly wider than the narrow tickets to be used in the retrofitted dispenser. For the case of this standard 1" wide tickets on a roll, the width of the top surface is preferably 1.02".

There are two edge openings in the top surface. The first opening 72 near the inlet end of the feed slide is provided for accommodating the sensing device 30 in the ticket dispenser. The second opening 74 nearer to the output end of the feed slide extends almost all of the way across the smooth top surface to accommodate the enlarged feed wheel 56 and enlarged diameter portions 66 of the drive roller and guide roller, respectively. At the input end of the feed slide 70, there is a flared down input portion 78 to make it easier to insert the tickets in between the feed slide and the top feed closure. The length of the preferred feed slide for use in the standard ticket dispenser is 5⅛" across the flat elongated portion of the slide. The flared down portion adds an additional portion 0.187" to the length of the feed slide.

The top slide closure 80 has a smooth bottom surface to permit easy movement of the tickets between the top slide closure and the feed slide. The top slide closure is provided with a plurality of nubs 86 that are aligned with the nubs on the feed slide for insertion into the same holes in the side framework plates of the ticket dispenser. The top slide closure has a first and second opening along its edge aligned with the first and second openings in the feed slide. At the input end of the top slide closure there is a flared up portion 88 to more easily accommodate the tickets. The length and width of the presently preferred top slide closure matches that of the feed slide.

Advantageously, with the ticket dispenser retrofit components in place in a standard ticket dispenser, a narrower ticket such as is found on a standard roll of tickets may be inserted through the input end of the feed slide and top slide closure. The narrower tickets are held by the longitudinal guide rail 75 against the side of the ticket dispenser with the sensing device. In addition, the guide rail protects against a user of the device from maliciously wiggling the tickets back and forth. On the contrary, the guide rail 75 holds the narrow tickets in proper position all along the length of the feed slide against the side plate of the dispenser. Near the output end of the feed slide, the tickets encounter the drive roller and the guide roller of the ticket dispenser retrofit. The enlarged feed wheel of the drive roller is disposed more to one end of the shaft so as to firmly grip the narrow tickets. The electrical operation of the retrofitted ticket dispenser is unchanged from the standard dispenser. Using the ticket dispenser retrofit of the present invention, amusement center owners that make use of the standard ticket dispenser in their amusement devices can advantageously enjoy huge cost savings by switching from the wider fan-folded tickets to the narrower ticket rolls.

Of course, it should be understood that various changes and modifications to the preferred embodiment described above will be apparent to those skilled in the art. For example, a longitudinal guide rail may be replaced by a series of stumps that hold the tickets in place against the side of the dispenser all along their length. This and other changes can be made without departing from the spirit and scope of the invention and without diminishing its attendant advantages. It is therefore intended that such changes and modifications be covered by the following claims.

I claim:

1. A ticket dispenser retrofit comprising:

a feed slide having a full width that provides for snug insertion within an automated ticket dispenser, said feed slide having longitudinal guide means protruding up from said feed slide, a smooth top surface adjacent the longitudinal guide means and narrower in width than the full width of said feed slide, a first opening in an edge of the top surface near an input end of said feed slide and a second opening in the smooth top surface near an output end of said feed slide, said feed slide being insertable within an automated ticket dispenser for guiding a web of tickets on the top surface along the longitudinal guide means; and a top slide closure having a flat bottom surface for resting upon the longitudinal guide means of said feed slide, a first opening for orientation in alignment with the first opening of said feed slide and a second opening for orientation with the second opening of said feed slide.

2. The ticket dispenser retrofit of claim 1 wherein the longitudinal guide means comprises a guide rail.

3. The ticket dispenser retrofit of claim 1 further comprising a drive roller having an axial length of approximately the full width of said feed slide, said drive roller including an enlarged feed wheel for mounting within said automated ticket dispenser with the outer periphery of the feed wheel exposed through the second opening of said feed slide.

4. The ticket dispenser of claim 3 wherein said enlarged feed wheel includes at least one rubber O-ring about its outer periphery.

5. The ticket dispenser retrofit of claim 4 further comprising a guide wheel for mounting within said automated ticket dispenser so that said guide wheel contacts the at least one O-ring through the second opening of said top slide closure.

6. The ticket dispenser retrofit of claim 1 wherein said feed slide further includes a flared down portion at the input end of said feed slide and said top slide closure further includes a flared up portion at the input end of said top slide closure.

7. The ticket dispenser retrofit of claim 1 wherein said feed slide further includes a plurality of nubs extending laterally out from the edges of said feed slide for insertion into mating holes in a ticket dispenser.

8. The ticket dispenser retrofit of claim 7 wherein said top slide closure further includes a plurality of nubs extending laterally out from the edges of said top slide closure, said plurality of nubs aligning with the plurality of nubs on said feed slide when said top slide closure is mounted within the ticket dispenser on top of said feed slide.

9. A ticket dispenser retrofit for converting a ticket dispenser for wide tickets into a ticket dispenser for narrower tickets, said retrofit comprising:

a drive roller including a hollow shaft, a set screw hole radially extending through the shaft and an enlarged drive wheel about the shaft disposed more to one end of the shaft;

a guide roller including a hollow shaft, a bearing in each end of the shaft and at least one enlarged diameter portion for exerting pressure against the enlarged feed wheel of said drive roller;

a feed slide being an elongated plate having a full width approximately equal to the length of the shaft of said guide roller, said feed slide having longitudinal guide means protruding up from said elongated plate, a smooth top surface adjacent the longitudinal guide means narrower in width than the full width of said elongated plate, a first opening in an edge of the top surface near an input end of said feed slide for accommodating an optical sensor in said ticket dispenser and a second opening in the smooth top surface near an output end of said feed slide extending from an edge of said elongated plate more than halfway across the full width of said elongated plate for accommodating the enlarged feed wheel of said drive roller, said feed slide being insertable within the automated ticket dispenser for guiding a web of narrow tickets on the top surface along the longitudinal guide means as said narrow tickets are pulled between said drive roller and said guide roller at the second opening; and a top slide closure having a flat bottom surface for resting upon the longitudinal guide means of said feed slide, a first opening for orientation in alignment with the first opening of said feed slide and a second opening for orientation in alignment with the second opening of said drive slide.

10. The ticket dispenser retrofit of claim 9 wherein the longitudinal guide means comprises a guide rail.

11. The ticket dispenser retrofit of claim 9 wherein the enlarged feed wheel of said drive roller includes at least one rubber O-ring about its outer periphery.

12. The ticket dispenser retrofit of claim 9 wherein said feed slide further includes a flared down portion at the input end of said feed slide and said top slide closure further includes a flared up portion at the input end of said top slide closure.

13. The ticket dispenser retrofit of claim 9 wherein said feed slide further includes a plurality of nubs extending laterally out from the edges of said feed slide for insertion into mating holes in the ticket dispenser.

14. The ticket dispenser retrofit of claim 13 wherein said top slide closure further includes a plurality of nubs extending laterally out from the edges of said top slide closure, said plurality of nubs aligning with the plurality of nubs on said feed slide when said top slide closure is mounted within the ticket dispenser on top of said feed slide.

15. The ticket dispenser retrofit of claim 9 wherein said drive roller further comprises a knurled periphery about the hollow shaft of the drive roller at an end of the shaft opposite the enlarged feed wheel.

* * * * *